US006711853B1

(12) United States Patent
Bergstrom

(10) Patent No.: US 6,711,853 B1
(45) Date of Patent: Mar. 30, 2004

(54) SUMMER WINDOW SAFETY GUARD AND METHOD THEREFOR

(76) Inventor: Sharon Bergstrom, 8514 E. Pasadena Ave., Scottsdale, AZ (US) 85250

( * ) Notice: Subject to any disclaimer, the term of this patent is extended or adjusted under 35 U.S.C. 154(b) by 0 days.

(21) Appl. No.: 10/320,843

(22) Filed: Dec. 16, 2002

(51) Int. Cl.[7] ..... E06B 3/68
(52) U.S. Cl. ..... 49/56; 49/449
(58) Field of Search ..... 49/50, 56, 57, 49/61, 63, 67, 449, 450

(56) References Cited

U.S. PATENT DOCUMENTS 1,591,078 A * 7/1926 Biddle ..... 49/56
1,718,995 A * 7/1929 Barnard ..... 292/60
4,573,285 A * 3/1986 Jokel ..... 49/55
4,848,030 A * 7/1989 Bennett ..... 49/57

* cited by examiner

*Primary Examiner*—Jerry Redman
(74) *Attorney, Agent, or Firm*—Jeffrey D. Moy; Harry M. Weiss; Weiss, Moy & Harris, P.C.

(57) ABSTRACT

A window safety guard is used for preventing an intrusive person or object from entering a home through a window when it is left open by the owner. It is also easily removable during emergency situations as it has a simple locking mechanism and may be removed as a single unit. The assembly has a series of vertical bars with tapered ends that are inserted into corresponding holes in a windowsill and in a bottom frame edge of a raised lower window. Support bars are coupled to the vertical bars to add strength and to help block the window opening. The window safety guard assembly also has a locking mechanism wherein a small rod is inserted in a corresponding hole in a side edge of an upper window frame. The small rod, when inserted, is also abutting the top frame edge of the raised lower window to prevent the lower window from being raised and the window safety guard from being removed.

10 Claims, 1 Drawing Sheet

SUMMER WINDOW SAFETY GUARD AND METHOD THEREFOR

BACKGROUND OF THE INVENTION

1. Field of the Invention

This invention relates generally to home safety, and more specifically, to a device for allowing an individual to sleep at night with the window open and without fear of intrusive people and objects entering through it. This same device further allows the individuals to quickly and easily remove it in the case of an emergency.

2. Background of the Invention

Many individuals desire to leave their windows open throughout the night to receive fresh air. Most windows are equipped with a screen that is a soft porous mesh. The screen allows fresh air to pass into the home and it generally keeps out unwanted objects. The problem with this simple screen, however, is that it is easily penetrable. An intruder may use a knife or other such sharp object to cut a hole through the mesh and thus gain access to the home. The screen is also not very sturdy. Even just a moderate amount of force could cause the mesh to be loosened from its frame and the screen would collapse.

Other windows, as another form of protection, are equipped with bars. These bars are often welded on the outside of the windows. While these bars may serve the purpose of keeping out intruders, they pose a safety hazard to the inhabitant. Should an emergency occur, such as a fire, the inhabitant would not be able to escape through the barred window. The apparatus that was intended for the inhabitant's safety, would then become the cause of his injury.

Yet another form of protective grill for windows consists of bars that collapse or disassemble for removal once they are unlocked. U.S. Pat. No. 5,437,134 illustrates collapsible grills consisting of a configuration of thin rods and pivotal connectors allowing for slide movement. The difficulty with the collapsible grills is that it is possible for it's numerous parts to malfunction. The rods may have been bent, thereby preventing them from being moved. It is also possible that their pivotal connectors may become worn with age or use. The grills that disassemble may consist of many parts that are to be removed separately once it is unlocked. U.S. Pat. No. 5,392,570 discloses a grill that consists of a plurality of security bars that must be removed individually. This process of unlocking and removing the grill becomes a hazard in the case of an emergency because it is too time consuming to have to unlock the apparatus and disassemble it piece by piece.

Therefore, a need existed to provide a system that would allow people to sleep at night safely with their window open. The system must protect an individual from intrusive people and objects, yet must be easily removable in the case of an emergency.

SUMMARY OF THE INVENTION

In accordance with one embodiment of the present invention, it is an object of the present invention to provide a system that would allow people to sleep at night safely with their window open.

It is another object of the present invention to provide a system that would protect an individual from burglars or other such intrusive people and objects and that would be easily removable in the case of an emergency.

BRIEF DESCRIPTION OF THE PREFERRED EMBODIMENTS

In accordance with one embodiment of the present invention, a window safety guard assembly is disclosed. The safety guard assembly has a plurality of vertical bars traversing a space between a windowsill and a bottom frame edge of a raised lower window. It also has at least one support bar coupled to the vertical bars and a locking mechanism coupled to an upper window frame.

In accordance with another embodiment of the present invention, a method of securing an open window is disclosed. The method comprises the steps of: providing a window safety guard assembly, positioning the window safety guard assembly to fit within a window opening; and locking the window safety guard assembly.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiment when read in conjunction with the accompanying drawings, wherein like reference numerals and symbols represent like elements.

DETAILED DESCRIPTION

Figure 3:
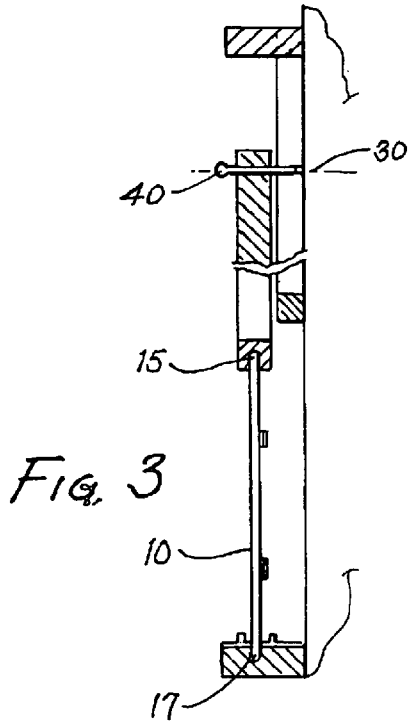
FIG. 3 is a cross-sectional view, taken along lines 3—3, of the window safety guard assembly of the present invention in use and installed in an open window.
Figure 1:
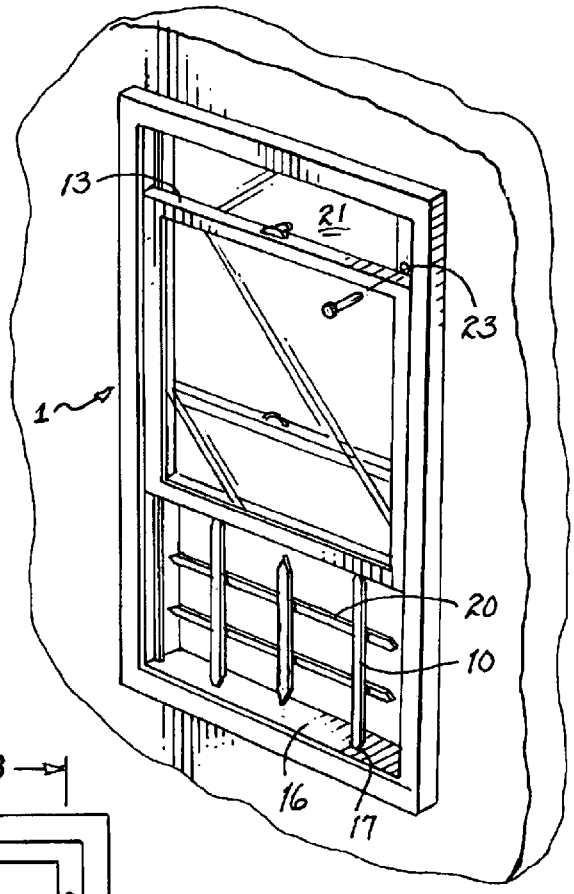
FIG. 1 is an elevated perspective view of the window safety guard assembly of the present invention in use and installed in an open window.
Figure 2:
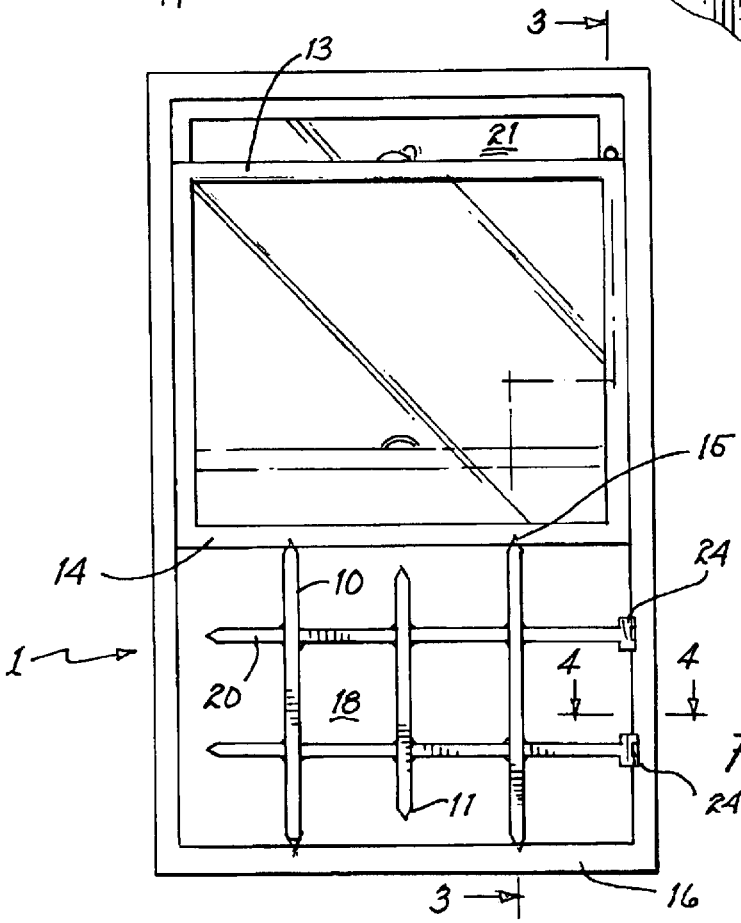
FIG. 2 is a front view of another embodiment of the window safety guard assembly of the present invention in use and installed in an open window.
Figure 4:
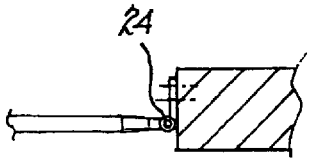
FIG. 4 is a top view of the hinges used in the embodiment depicted in FIG. 2.

Referring to FIGS. 1–3 wherein like numerals and symbols represent like elements, a window safety guard assembly 1 is shown. The window safety guard assembly 1 is positioned to block the window opening 18. By blocking the window opening 18, an individual may sleep at night with their window open and without worrying about burglars or other intrusive people and objects from entering the home. It is also easily removable during emergency situations as it has a simple locking mechanism 30 and may be removed as a single unit.

For blocking the window opening 18, the window safety guard assembly 1 has vertical bars 10 that extend from the windowsill 16 of a window frame up to the bottom frame edge of the raised lower window 14. There is a plurality of holes on the windowsill 17 and on the bottom frame edge of the lower window 15. The vertical bars 10 have tapered ends 11 that are inserted into the holes on the bottom frame edge of the lower window 15 and into the holes on the windowsill 17. By inserting the tapered ends 11, the vertical bars 10 will be held firmly within the window opening 18.

Support bars 20 are coupled to the vertical bars 10. This reinforces the vertical bars 10 by preventing any possible bending or spreading of the vertical bars 10. The support bars 20 also serve to help block the window opening 18.

The window safety guard 1 has a locking mechanism 40 to hold the window safety guard 1 in place and to prevent its removal. The locking mechanism 40 comprises a small rod 30 and plurality of holes 23 along the side edge of the upper window 22. The safety guard assembly 1 is locked into place by inserting the small rod 30 into a corresponding hole in the side edge of the upper window frame 23. This small rod 30, while inserted into a corresponding hole in the side edge of the upper window frame 23, will also be abutting the top edge of the lower window frame 13. While the small rod 30 is in its position, it will prevent the lower window 12 from being raised to remove the window safety guard 1.

For removal of the window safety guard 1, the individual will remove the small rod 30 from its hole in the side edge of the upper window frame 23. The lower window 12 will be slightly raised to disengage the tapered ends 11 of the vertical bars 10 from the holes in the windowsill 17 and the holes in the bottom frame edge of the lower window 14. Once the window safety guard 1 is removed, the inhabitant may exit through the window.

As may be seen in FIG. 2, in accordance with one embodiment of the present invention, the window safety guard 1 is movably coupled to the window frame 13 by a pair of hinges 24. The hinges 24 will allow one to easily move the window safety guard 1 to the side, in order to close the opening 18 in the window. In order to move the window safety guard 1, one has to lift the window safety guard 1 out of the holes 17 in the window sill and rotate the window safety guard 1 to the side.

For added security, a metal mesh may be used to cover the openings between the vertical bars 10 and the support bars 20. The metal mesh would be fairly thick so that one would not be able to cut the metal mesh with a knife or the like. The metal mesh would be used so that small hands would not be able to reach inside the home through the openings in the safety guard 1. The metal mesh would also prevent small insects and animals from entering the home through the openings.

Although the invention has been particularly shown and described with reference to preferred embodiments thereof, it will be understood by those skilled in the art that the foregoing and other changes in form and details may be made therein without departing from the spirit and scope of the invention.

What is claimed is:

1. A window safety guard assembly for preventing the entrance of intrusive people and objects while allowing for quick and easy removal by the inhabitant in the case of an emergency comprising:

a plurality of vertical bars traversing a space between a windowsill and a bottom frame edge of a lower window;

at least one support bar coupled to said vertical bars; and a locking mechanism coupled to a window frame.

2. A window safety guard assembly in accordance with claim 1 further comprising a plurality of holes along the windowsill for holding the vertical bars in place.

3. A window safety guard assembly in accordance with claim 1 further comprising a plurality of holes along the bottom frame edge of the lower window for holding the vertical bars in place.

4. A window safety guard assembly in accordance with claim 1 wherein said tapered ends are inserted into the corresponding holes in the windowsill and in the bottom frame edge of the lower window thereby holding the safety guard assembly firmly into place.

5. A window safety guard assembly in accordance with claim 1 wherein the vertical bars and the support bars are arranged so as to prevent passage of a hand and other such intrusive objects.

6. A window safety guard assembly in accordance with claim 1 further comprising a plurality of holes along a side edge of the upper window frame thereby allowing for adjustment into varying window sizes.

7. A window safety guard assembly in accordance with claim 1, wherein said locking mechanism further comprises a small rod and said small rod is inserted into a corresponding hole in the side edge of the upper window frame and is abutting a top frame edge of the lower window thereby preventing the lower window from being raised to remove the safety guard.

8. The vertical bars, support bars and locking mechanism of claim 1 being made of a resilient metal.

9. A window safety guard assembly in accordance with claim 1 further comprising at least one hinge coupled to the support bar and to the window frame for moving the window safety guard assembly.

10. A window safety guard for preventing the entrance of intrusive people and objects, while allowing for quick and easy removal by the inhabitant in the case of an emergency comprising:

a plurality of vertical bars traversing a space between a windowsill and a bottom frame edge of a lower window;

at least one support bar coupled to the vertical bars;

an arrangement of the vertical bars and the support bars so as to prevent passage of a hand and other such intrusive objects;

a plurality of holes along the windowsill for holding the vertical bars in place;

a plurality of holes along the bottom edge of the lower window frame for holding the vertical bars in place;

tapered ends on said vertical bars for insertion into the corresponding holes along the windowsill and along the bottom edge of the lower window frame;

a plurality of holes along the side edge of the upper window frame allowing for the safety guard to be adjusted into varying window sizes; and a locking mechanism comprising a small rod for insertion into a corresponding hole along the side edge of the upper window frame and abutting the upper edge of the lower window frame to prevent the lower window from being raised to remove the safety guard assembly.

* * * * *